United States Patent [19]

Kakita et al.

[11] 4,236,435

[45] Dec. 2, 1980

[54] KEYING SYSTEM IN AN ELECTRONIC MUSICAL INSTRUMENT

[75] Inventors: Minoru Kakita, Hino; Tsuneo Kosugi, Hachiohji, both of Japan

[73] Assignee: Victor Company of Japan, Limited, Yokohama, Japan

[21] Appl. No.: 906,347

[22] Filed: May 15, 1978

[30] Foreign Application Priority Data

May 16, 1977 [JP] Japan ..... 52-56137

[51] Int. Cl.³ ..... G10H 1/06

[52] U.S. Cl. ..... 84/1.22; 84/1.26

[58] Field of Search ..... 84/1.07, 1.11, 1.12, 84/1.19, 1.21, 1.22, DIG. 11, 1.26, DIG. 23

[56] References Cited

U.S. PATENT DOCUMENTS

| | | | |
|---|---|---|---|
| 3,569,605 | 3/1971 | Adachi | 84/1.22 |
| 3,580,980 | 5/1971 | Uetrecht | 84/1.22 |
| 3,636,231 | 1/1972 | Schrecongost | 84/1.23 |
| 3,828,109 | 8/1974 | Morez | 84/DIG. 4 |
| 3,836,693 | 9/1974 | Ichikawa | 84/1.23 |

*Primary Examiner*—J. V. Truhe

*Assistant Examiner*—Forester W. Isen

*Attorney, Agent, or Firm*—Haseltine, Lake & Waters

[57] ABSTRACT

A keying system in an electrocin musical instrument comprises a circuit for generating harmonic level control voltages for controlling the levels respectively of harmonics (inclusive of the first harmonic, i.e., the fundamental tone), a circuit provided in correspondence to the keys of a keyboard of the musical instrument and responding to manipulations of said keys to generate envelope control voltages, an addition circuit for respectively adding the envelope control voltages corresponding to the keys and the said harmonic level control voltages, a mixing circuit for mixing outputs respectively corresponding to the same letter names among the outputs of said addition means, a sound-source circuit for generating sound-source signals of frequencies respectively of the harmonics (inclusive of the fundamental tone) corresponding to the keys, and a circuit for gating the sound-source signals of the frequencies of the letter names corresponding to said outputs among the signals from said sound source circuit through the use of the outputs of said mixing means.

5 Claims, 9 Drawing Figures

FIG.1A

| HARMONICS / KEY NAME | 1/2 (16') | 1 (8') | 3/2 (5 1/3') | 2 (4') | 3 (2 2/3') | 4 (2') | 5 (1 3/5') | 6 (1 1/3') | 8 (1') |
|---|---|---|---|---|---|---|---|---|---|
| $C_7$ | $C_6$ | $C_7$ | $G_7$ | $C_8$ | $G_8$ | $C_9$ | $E_8$ | $G_8$ | $C_9$ |
| $B_6$ | $B_5$ | $B_6$ | $F^{\#}_7$ | $B_7$ | $F^{\#}_8$ | $B_8$ | | | |
| $A^{\#}_6$ | | | | | | | | | |
| $A_6$ | | | | | | | $C^{\#}_8$ | | |
| $G^{\#}_6$ | | | | | | | $C_9$ | | |
| $G_6$ | | | | | | | | | |
| $F^{\#}_6$ | | | | | | | | $C^{\#}_8$ | |
| $F_6$ | | | | | | | | $C_9$ | |
| $E_6$ | | | | | | | | | |
| $D^{\#}_6$ | | | | | | | | | |
| $D_6$ | | | | | | | | | |
| $C^{\#}_6$ | $C^{\#}_5$ | $C^{\#}_6$ | $G^{\#}_6$ | $C^{\#}_7$ | $G^{\#}_7$ | $C^{\#}_8$ | | | $C^{\#}_8$ |
| $C_6$ | $C_5$ | $C_6$ | $G_6$ | $C_7$ | $G_7$ | $C_8$ | $E_8$ | $G_8$ | $C_9$ |
| $B_5$ | $B_4$ | $B_5$ | $F^{\#}_6$ | $B_6$ | $F^{\#}_7$ | $B_7$ | $D^{\#}_8$ | $F^{\#}_8$ | $B_8$ |
| $A^{\#}_5$ | $A^{\#}_4$ | $A^{\#}_5$ | $F_6$ | $A^{\#}_6$ | $F_7$ | $A^{\#}_7$ | $D_8$ | $F_8$ | $A^{\#}_8$ |
| $A_5$ | | | | | | | | | |
| $G^{\#}_5$ | | | | | | | | | |
| $G_5$ | | | | | | | | | |
| $F^{\#}_5$ | | | | | | | | | |
| $F_5$ | | | $C_6$ | | | | | | |
| $E_5$ | | | | | | | | | |
| $D^{\#}_5$ | | | | | | | | | |
| $D_5$ | | | | | | | | | |
| $C^{\#}_5$ | $C^{\#}_4$ | $C^{\#}_5$ | $G^{\#}_5$ | $C^{\#}_6$ | $G^{\#}_6$ | $C^{\#}_7$ | $F_7$ | $G^{\#}_7$ | $C^{\#}_8$ |
| $C_5$ | $C_4$ | $C_5$ | $G_5$ | $C_6$ | $G_6$ | $C_7$ | $E_7$ | $G_7$ | $C_8$ |
| $B_4$ | $B_3$ | $B_4$ | $F^{\#}_5$ | $B_5$ | $F^{\#}_6$ | $B_6$ | $D^{\#}_7$ | $F^{\#}_7$ | $B_7$ |
| $A^{\#}_4$ | $A^{\#}_3$ | $A^{\#}_4$ | $F_5$ | $A^{\#}_5$ | $F_6$ | $A^{\#}_6$ | $D_7$ | $F_7$ | $A^{\#}_7$ |

44 KEYS

X

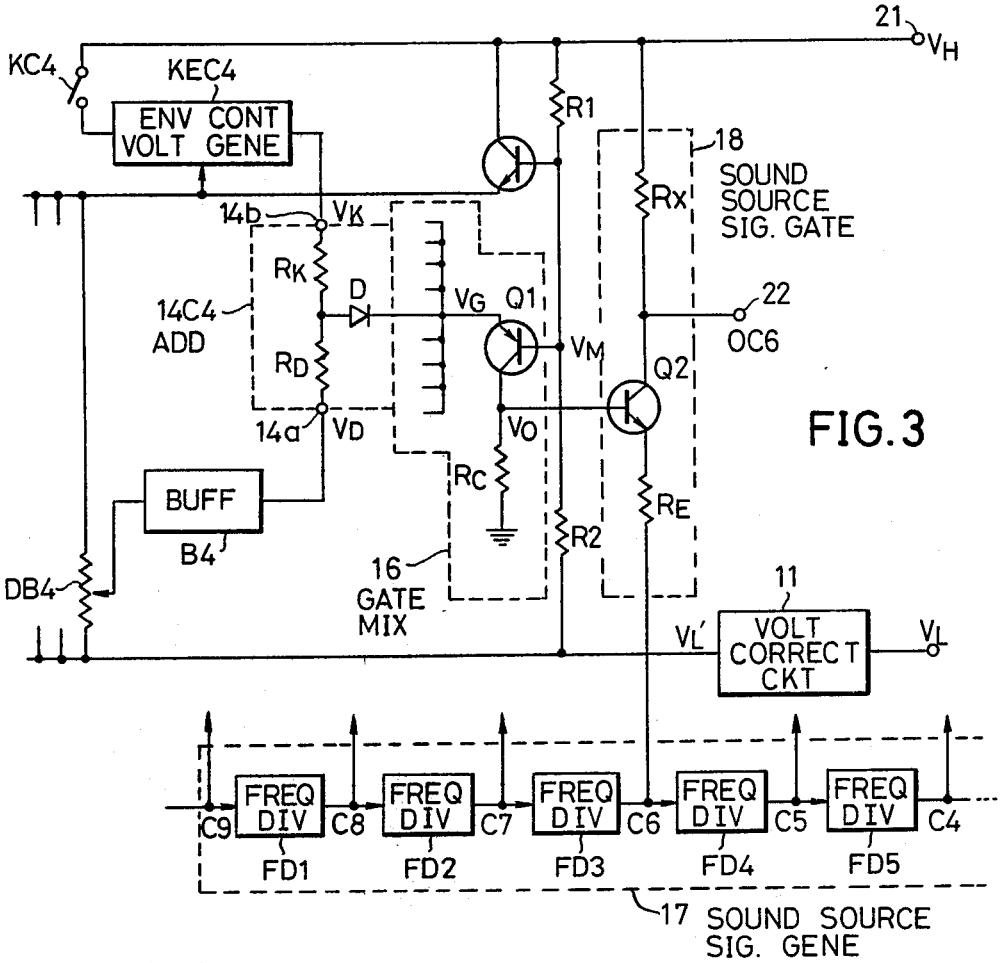
FIG. 3
FIG. 4A
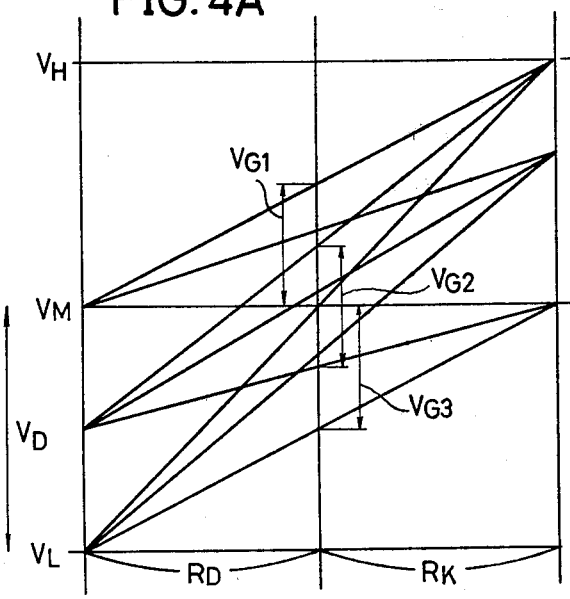
FIG. 4B
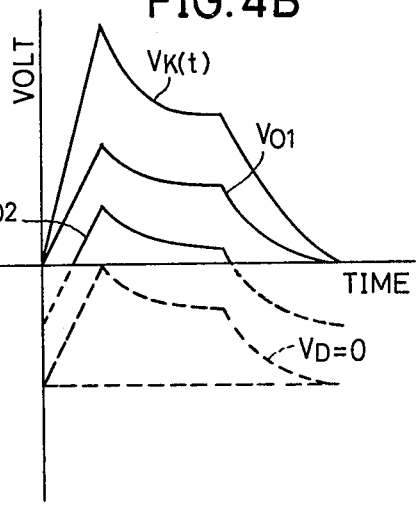

ENV CONT VOLT GENE
KEC7
KEC6
KEF5
KEC5
KEF4
KEC4
KEG#3
KEF3
KEC3
BUFF
B1
B2
B3
B4
B5
B6
B7
B8
B9
ADD
14-1
14-2
14-3
14-4
14-5
14-6
14-7
14-8
14-9
Q1
VH
R1
R2
VO
RC
VL

KEYING SYSTEM IN AN ELECTRONIC MUSICAL INSTRUMENT

BACKGROUND OF THE INVENTION

The present invention relates generally to keying systems of electronic musical instruments and more particularly to a keying system of simplified circuitry in an electronic organ in which a harmonic synthesis system is used.

An electronic musical instrument, in general, is so constituted and adapted as to carry out the functions of electronically generating a sound source signal, turning this signal "ON" or "OFF" or controlling the amplitude thereof in response to manipulation of keyboard, obtaining a signal having a frequency corresponding to the keyboard and a musical tone waveform having harmonics (higher harmonics) spectrum, and converting this signal into sound.

The factors which determine the tone color of an electronic musical instrument are essentially: (a) the manner in which harmonics are included; (b) the variations with time (envelopes) of the levels of the fundamental tone and the harmonics; (c) noise, distortion, and dynamic range; and (d) other sound field effects. Of these factors, the factor (a), the manner in which harmonics are included, is important, and the greater the number of harmonics included, the more colorful and fuller is the tone color obtained.

A conventional synthesis type organ in which a sine-wave synthesis system is used produces musical tones by suitably synthesizing 9 harmonics from the ½ harmonic to the 8th harmonic. In an organ of this synthesis type, harmonic adjusters operated by draw bars and comprising variable resistors are provided and used to adjust the levels of the synthesized harmonics thereby to variably adjust the tone color.

In an organ of this synthesis type, however, the number of gate circuits required for signal "ON-OFF" operation in response to keyboard manipulation has been the product of the number of the keys and the number of the harmonic adjusters. For example, in the case of 49 keys and 9 harmonic adjusters, $49 \times 9 = 441$ gate circuits are required. Ordinarily, for a single gate circuit, approximately 10 components such as transistors, diodes, resistors, and capacitors are required. Accordingly, a total of some 4,400 components are required in this organ. As a consequence, a conventional synthesis type organ has been accompanied by the problems of complicated circuitry, large required number of components, and high price.

Furthermore, in order to change the envelope for each harmonic, it has been necessary to increase the number of harmonic series of different envelopes together with the number of gate circuits for exclusive use thereof or to use a circuit organization wherein switching is carried out by a gang switch between ordinary envelope circuits and attack envelope forming circuits. Consequently, this gives rise to further complication of the circuit organization.

Another conventional electronic organ is the organ of bright-wave type wherein a Formant system is used. In this bright-wave type organ, a signal of a waveform containing in abundant harmonics of waves such as saw-tooth waves and pulse waves is used as a sound source signal, and the manner in which these harmonics are contained is adjusted by means such as filters thereby to obtain tones of the desired tone color. However, the signal of the above described waveform contains only odd harmonics and does not contain even harmonics. For this reason, the tone color of this organ is monotonic in comparison with that of the synthesis type organ. Furthermore, it is very difficult to design the filters used for determining the manner in which the harmonics are contained so that they will have ideally sharp characteristics.

SUMMARY OF THE INVENTION

Accordingly, it is an object of the present invention to provide a novel and useful keying system of an electronic musical instrument in which the above described difficulties are overcome.

Another object of the invention is to provide a keying system by which the number of gate circuits in an organ of synthesis type of rich tone color can be reduced. By the use of the keying system of the invention, the number of gate circuits may be made equal to that of the sound sources, whereby the circuit organization is simple, requiring only a relatively small number of components, and can be produced at low cost.

Still another object of the invention is to provide a keying system of an electronic musical instrument capable of easily accomplishing fine harmonic adjustment without the occurrence of noise, distortion, and like disturbances.

Other objects and further features of the invention will be apparent from the following detailed description when read in conjunction with the accompanying drawings.

BRIEF DESCRIPTION OF THE DRAWINGS

In the drawings:

FIGS. 1A and 1B constitute a chart for a description of the sound sources necessary for combining keys and harmonics in an electronic organ system;

FIG. 3 is a schematic circuit diagram showing one part of the system shown in block form in FIG. 2;

FIGS. 4A and 4B are graphs for a description of the operation by which the sound source gate output is controlled by the key-envelope voltage and the harmonic adjuster voltage;

DETAILED DESCRIPTION

Figure 1B:
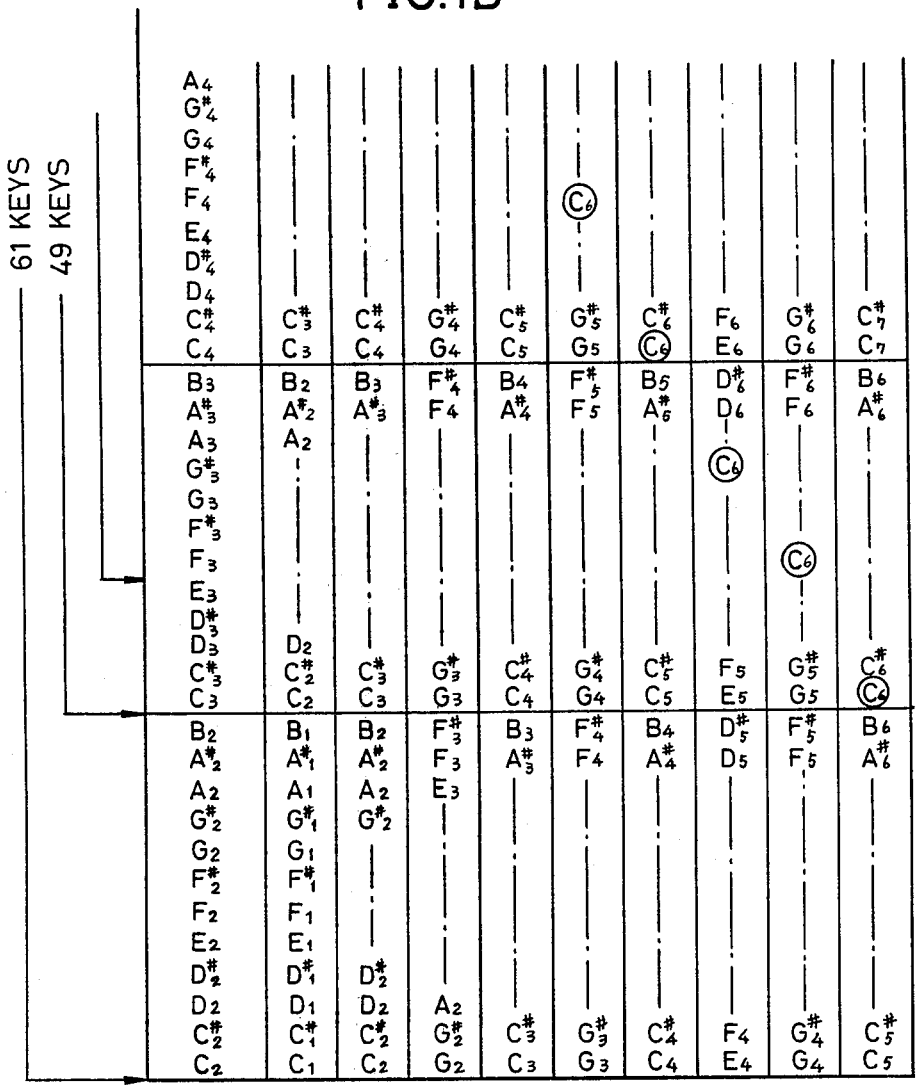

First, for a consideration of the number of sound sources required in an organ system, combinations of keys and harmonics are indicated by the chart of FIGS. 1A and 1B. The extreme left column indicates the key names. The letter names which have relationships of harmonics of ½, 1, 3/2, 2, 3, 4, 5, 6, and 8 with respect to the fundamental tones of these key names are set forth, with a part deleted, in the succeeding columns of this chart. Since the 1 harmonic is the same as the fundamental tone of each letter name, the 1 harmonic is expressed as the "fundamental" in some cases in addition to the case wherein it is included in the expression of "harmonics".

For the number of keys in a keyboard, there are kinds such as the 44 keys from F3 to C7, the 49 keys from C3 to C7, and the 61 keys from C2 to C7. In the case of electronic organs, 49 keys are widely used. The relationships of the frequencies are such that, when A4 is selected at 440.0 Hz: C1 is 32.703 Hz as the standard pitch; C2 is twice C1; C3 is 4 times C1; . . .; and Cn is $2^{n-1}$ times C1. In addition, C#, D, . . . B, etc., are musical scale names generally known equal temperament.

In principle, therefore, the required number of sound-source frequency oscillators for generating the frequencies of the tones of the letter names indicated in the chart with respect to the fundamentals and their harmonics of the letter names corresponding to the key names becomes the number of all letter names.

However, since the frequencies of C9 and higher tones are above 8,000 Hz, and it is difficult to sense the musical intervals by ear, with respect to harmonics within the portion X enclosed by the thick line in the chart of FIG. 1A, a sound source one octave lower is substituted (used doubly) in the present embodiment of the invention.

Furthermore, letter names of the ½ harmonic for the C7 key, the 1st harmonic, that is, the fundamental, for the C6 key, the 2nd harmonic for the C5 key, the 3rd harmonic for the F4 key, the 4th harmonic for the C4 key, the 5th harmonic for the G3# key, the 6th harmonic for the F3 key, and the 8th harmonic for the C3 key, for example, are all C6. Accordingly, as the sound source of all of these tones, a single oscillator which generates the frequency of the tone of the letter name C6 can be commonly used.

Therefore, in accordance with the present embodiment of the invention, 85 sound-source oscillators are used in the case, for example, of 49 keys.

Next, a generalized block system of one embodiment of the keying system according to the invention will be described in conjunction with FIG. 2.

For level adjustments of ½, 1st, 3/2, 2nd, 3rd, . . . 8th harmonics, respectively, there are provided harmonic adjusters DB1, DB2, . . . DB9, respectively comprising variable resistors the sliders of which can be varied by the operation of draw bars, and which are connected to a circuit 11 for correction of the harmonic adjusting voltages. The harmonic level control voltages from the harmonic adjusters DB1 through DB9 are applied, through buffer circuits B1 through B9 (designated in entirety by the reference numeral 12) for converting impedances, to an addition circuit matrix 13. This addition circuit matrix 13 is provided with a plurality of addition circuits (only one addition circuit 14 being shown as a representative example in FIG. 2) arranged in the state of a matrix. Each control voltage $V_D$ from the buffer circuit 12 is applied to the input terminal of a corresponding one of the addition circuits, for example, terminal 14*a* of the addition circuit 14.

Key switches K1 through K49 are provided to correspond to the keys. Since the present embodiment of the invention is of the 49-key type, the same number, 49, of key switches are provided. By depressing any key, the key switch corresponding to that key is closed.

When a key switch is thus closed, a voltage is applied to an envelope control voltage generating circuit corresponding to the closed key switch among a group of envelope control voltage generating circuits KE1 through KE49 (designated in entirety by reference numeral 15), whereupon an envelope control voltage is generated. This envelope control voltage $V_K$ is applied to the terminal 14*b* of the corresponding addition circuit 14 in the addition circuit matrix 13.

In the addition circuit matrix 13, addition is carried out by 9 individually different addition circuits respectively with the outputs of the 9 buffer circuits B1 through B9 for each of the outputs of the 49 envelope control voltage generating circuits. For this reason, $49\times9=441$ addition circuits are provided in the case of the present embodiment of the invention. Therefore, by depressing one key out of the 49 keys, the 9 addition outputs of the envelope control voltage corresponding to that key and the 9 harmonic level control voltages are obtained from the addition circuit matrix 13. Thus, 9 outputs corresponding to each key are obtained, and a total of 441 kinds of outputs are obtained in the present embodiment of the invention.

The outputs from the addition circuit matrix 13 are respectively supplied to a gate mixing circuit 16, where outputs corresponding to the same letter name are added (mixed), and the 441 outputs of the addition circuit matrix 13 are compiled into 85, that is, into the same number as the number (85) of sound-source oscillators for generating frequency signals respectively of the letter names of a sound-source circuit 17 used in the present embodiment of the invention.

The outputs of the gate mixing circuit 16 are supplied to a sound-source signal gate circuit 18, where they gate the sound-source signals from the sound-source signal generator 17. The resulting outputs of the sound-source signal gate circuit 18 are supplied to an octave mixer 19 and there compiled by octave. Since each octave comprises 12 tones, outputs 01 through 07 are obtained for each of the 7 octaves in the present embodiment of the invention. If the circuit arrangement were such that a filter is used for passing each tone, 85 filters would be required, and the circuit organization would become complicated. As a countermeasure in the present embodiment of the invention, the outputs are compiled for each octave, whereby 7 filters for use in the after stage of the octave mixer 19 are sufficient.

A voltage $V_L'$ applied to the common line of the harmonic adjusters DB1 through DB9 becomes high as the plurality of draw bars are drawn out, the harmonic adjusters are varied, and the harmonic adjusting voltage correction circuit is controlled. Furthermore, together with this variation, a voltage $V_M$ divided by resistors R1 and R2 and applied to the gate mixing circuit 16 also becomes high. For this reason, the range of voltages applied to the harmonic adjusters becomes small. Therefore, even when the tone color is varied by means of a plurality of harmonic adjusters, the output amplitude of the sound-source signal gate circuit 18 is maintained substantially constant.

Figure 2:
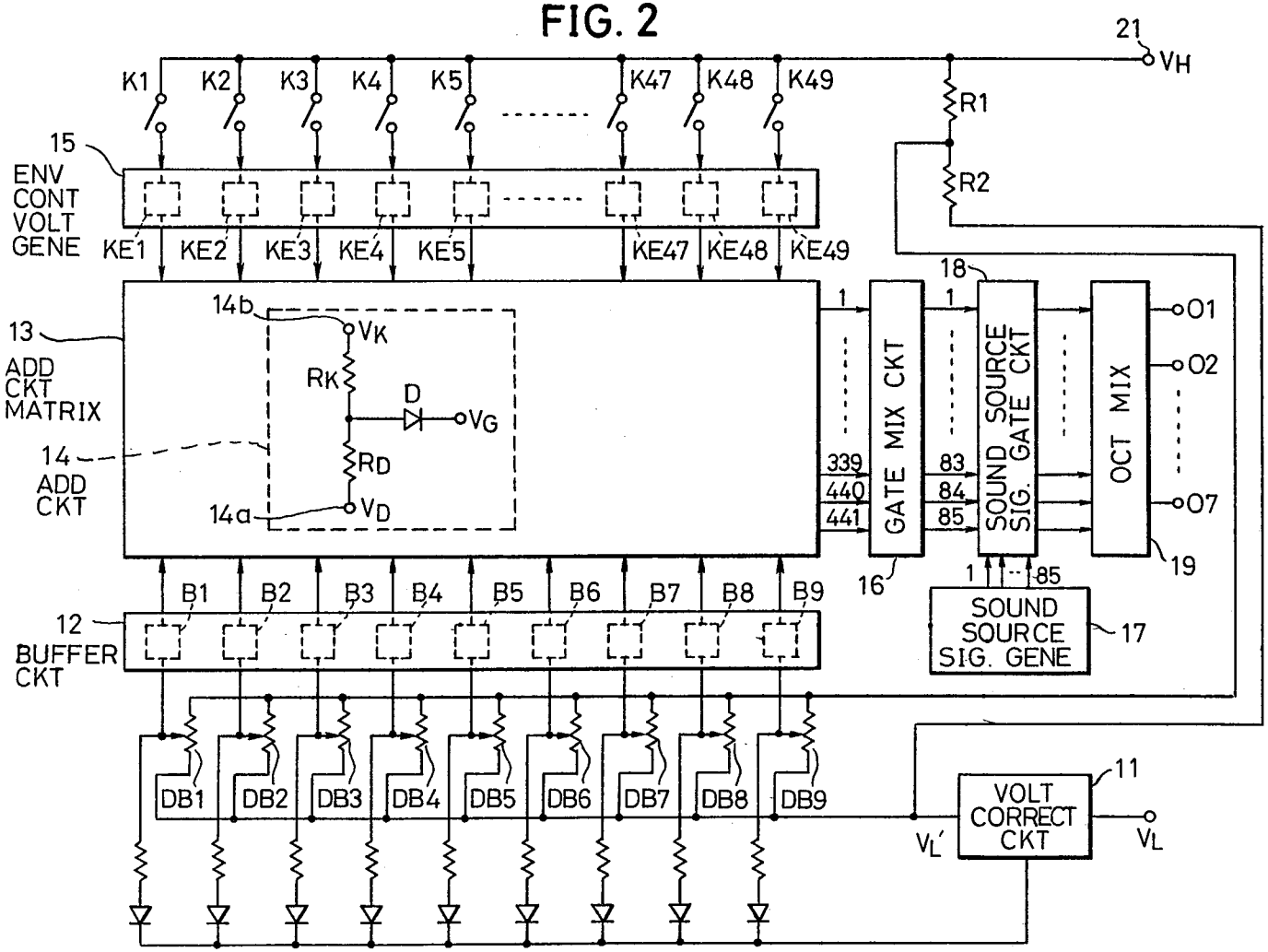
FIG. 2 is a schematic block diagram showing the essential organization of one embodiment of the keying system according to the invention of an electronic musical instrument (electronic organ)

One part of an essential part of the system shown in block form in FIG. 2 is shown as a specific circuit in concrete form in FIG. 3. When the key of the letter name C4, for example, is depressed, a corresponding key switch KC4 is closed, whereby an envelope-control voltage generating circuit KEC4 produces as output an envelope control voltage, which is applied to the terminal 14*b* of an addition circuit 14C4. As a consequence, an envelope-control voltage $V_K$ which varies from a medium voltage $V_M$ resulting from the division of the voltage $V_H$ of a terminal 21 by the resistors R1 and R2 to the voltage $V_H$ is applied to a resistor $R_K$. On the other hand, a harmonic level control voltage from the harmonic adjuster DB4 for the 4th harmonic is passed through the buffer circuit B4 and applied through the terminal 14a of the addition circuit 14C4 to a resistor $R_D$.

An addition voltage $V_G$ produced by the addition of the two control voltages through the resistors $R_K$ and $R_D$ is applied from the junction point between the resistors $R_K$ and $R_D$, through a diode D for preventing straying of the signal to other addition circuits, and to the emitter of a transistor Q1 constituting the gate-mixing circuit 16. The above mentioned medium voltage $V_M$ is being applied to the base of this transistor Q1, between whose collector and ground (earth), a resistor $R_C$ is connected.

From the collector of the transistor Q1, a voltage $V_O$ related to the voltage difference between the addition voltage $V_G$ and the medium voltage $V_M$ is obtained as described hereinafter and is applied to the base of a transistor Q2 constituting the sound-source signal gate circuit 18. The collector of the transistor Q2 is connected through a resistor $R_X$ to the above mentioned terminal 21, and the emitter thereof is connected by way of a resistor $R_E$ to the sound-source signal generator 17.

In the sound-source signal generator 17, there are provided a number of frequency-dividing circuits each comprising a frequency divider FD1 supplied with a signal from the highest-octave signal source and operating to frequency divide this signal and a plurality of frequency dividers FD2, FD3, . . . connected successively in cascade arrangement to the frequency divider FD1 and respectively operating to frequency divide frequency-divided outputs successively by one half. In the present embodiment of the invention, 12 of these frequency-dividing circuits are provided. In the circuit part illustrated in FIG. 3, the emitter of the transistor Q2 is connected to the side of the output C6 of the frequency divider FD3. In this case, it is necessary that the "ON-OFF" levels of the frequency divider outputs be higher than the above mentioned voltage $V_O$. The sides of the outputs C9, C8, . . . are also respectively connected to their corresponding sound-source signal gate circuits.

When the above mentioned voltage $V_O$ is equal to the ground (earth) potential, that is, when the transistor Q1 is in its OFF state, no signal appears at the collector of the transistor Q2. When the voltage $V_O$ becomes positive, a signal from the sound-source circuit 17 (a signal of the tone of the letter name C6 in the illustrated example) of an amplitude proportional to the magnitude of the voltage $V_O$ is obtained at an output terminal 22.

The relationships between the envelope control voltage, the harmonic level control voltage, and the sound-source gate circuit output will now be described in conjunction with FIGS. 4A and 4B. FIG. 4A indicates the range within which the addition voltage $V_G$ varies when the values of the envelope control voltage $V_K$ and the harmonic level control voltage $V_D$ are varied. For example, in the case where the control voltage $V_D$ is the medium voltage $V_M$, and the control voltage $V_K$ varies between the voltages $V_H$ and $V_M$, the addition voltage $V_G$ varies within the range denoted by $V_{G1}$. When the control voltage $V_D$ is of a value intermediate between the voltages $V_M$ and $V_L$, the addition voltage $V_G$ varies within the range denoted by $V_{G2}$ in response to the variation of the control voltage $V_K$ between the voltages $V_H$ and $V_M$. When the control voltage $V_D$ is the voltage $V_L$, the addition voltage $V_G$ varies within the range denoted by $V_{G3}$ in response to the variation of the control voltage $V_K$ between the voltages $V_H$ and $V_M$.

FIG. 4B indicates the relationship of the output voltage $V_O$ to the addition voltage, which varies within the above mentioned range, in the case where the envelope control voltage $V_K$ is a voltage $V_K(t)$ of the waveform indicated in FIG. 4B which varies with time. In the case where the control voltage $V_D$ is the voltage $V_M$, and the addition voltage $V_G$ varies within the range $V_{G1}$, the output voltage $V_O$ is obtained with a waveform as indicated by $V_{O1}$. In the case where the control voltage $V_D$ is of a value intermediate between the voltages $V_M$ and $V_L$, and the addition voltage $V_G$ varies in the range $V_{G2}$, the output voltage is obtained with a waveform as indicated by $V_{O2}$. In the case where the control voltage $V_D$ is the voltage $V_L$, no output is obtained, and the sound-source gate circuit 18 does not open.

Accordingly, in the case of maximum harmonic level control voltage, an output of the same waveform as the waveform $V_{O1}$ substantially similar to the envelope control voltage $V_K(t)$ is obtained at the output terminal 22. In the case where the harmonic level control voltage is of a medium value, an output with the same waveform as the waveform $V_{O2}$ and with a slight time delay relative to the initial point of the voltage $V_K(t)$ is obtained at the output terminal 22. In the case of minimum level control voltage, no output is obtained.

Figure 5:
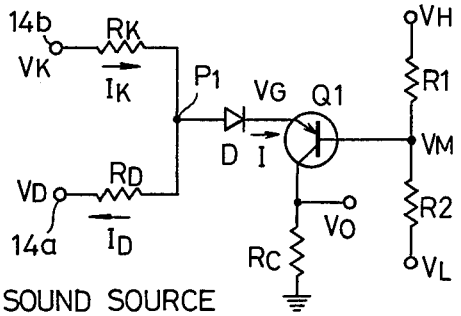
FIG. 5 is a circuit diagram showing one unit circuit part of an addition circuit and a gate mixing circuit.

The current addition operation within the addition circuit and the gate mixing circuit will now be analized and described with reference to FIG. 5. The envelope control current flowing into the circuit through the terminal 14b to the resistor $R_K$ will be denoted by $I_K$, the harmonic level control current flowing out from the resistor $R_D$ through the terminal 14a by $I_D$, and the current flowing into the emitter of the transistor Q1 from the junction point P1 between the resistors $R_K$ and $R_D$ by I. Then the output voltage $V_O$ obtained between the terminals of the resistor $R_C$ is given by the following equation.

$$V_O = IR_C = (I_K - I_D)\,R_C = \left(\frac{V_K - V_G}{R_K} - \frac{V_G - V_D}{R_D}\right) R_C$$

When the voltage $V_{BE}$ between the base and emitter of the transistor Q1 is neglected, $V_G = V_M$, and $R_K = R_D = R$, the following equation is obtained.

$$V_O = (V_K + V_D - 2V_M)\,R_C/R$$

FIG. 4A is a nomographical representation of the this equation with $R_C/R$ taken as 0.5.

Figure 6:
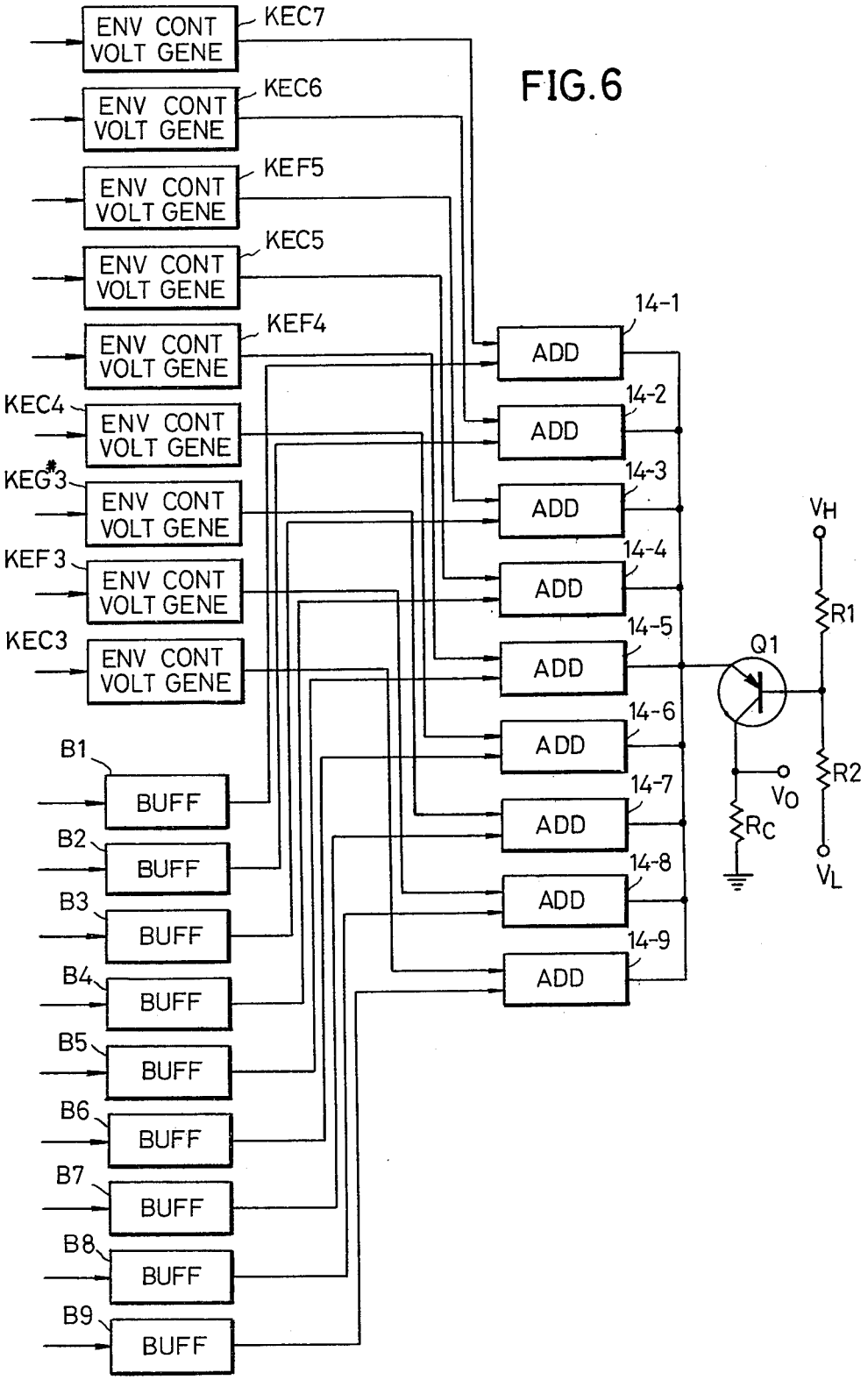
FIG. 6 is a schematic block diagram of one part of the addition circuit matrix.

An example of the addition circuit matrix 13 and one part of the gate-mixing circuit 16 is illustrated in FIG. 6. The envelope control voltage generating circuits corresponding to the keys of, for example, key name C7, C6, F5, C5, F4, C4, G3♯, F3, and C3 are respectively connected to the addition circuits 14-1 through 14-9. Furthermore, the buffer circuits B1 through B9 respectively for ½, 1st, 2nd, . . . 8th harmonics are respectively connected to the addition circuits 14-1 through 14-9. The output sides of the addition circuits 14-1 through 14-9 are commonly connected to the emitter of one transistor Q1 of the gate mixing circuit.

Therefore, when any of the keys of the above mentioned key names C7 through C3 is depressed, the sound-source signal of the letter name C6 encircled in the chart of FIGS. 1A and 1B is produced as a gate output. The circuits for the other tones are similarly constituted.

Figure 7:
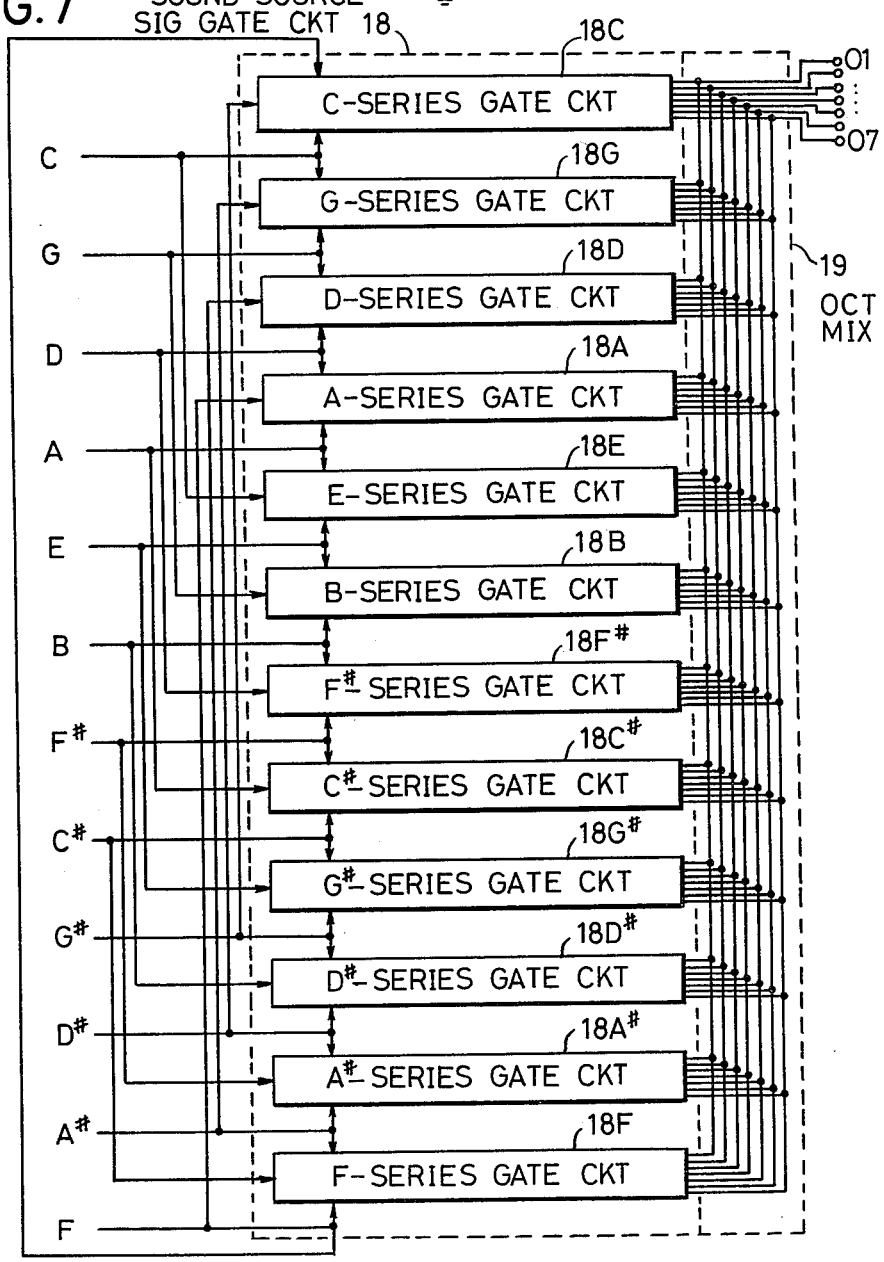
FIG. 7 is a schematic block diagram showing the sound source gate circuit and the octave mixer part of each letter name.

The block connection system of the sound-source signal gate circuit 18 and the octave mixer 19 is schematically illustrated in FIG. 7. In the sound-source signal gate circuit 18, the C-series sound-source signal gate circuit 18C, for example, is related to the C-series key switch, the F-series key switch, and the G#-series key switch and respectively constitutes addition circuits between the harmonics of the fifth-degree relation and the third-degree relation. The features of the other sound-source signal gate circuits 18G through 18F are similar, as shown in FIG. 7. It is to be noted that, because of an arrangement wherein the C-series and D-series sound-source signal gate circuits are disposed on opposite adjacent sides of the G-series sound-source signal gate circuit, for example, there are few crossings of signal lines, whereby the wiring can be simplified.

The outputs of the sound-source signal gate circuits 18C through 18F are subjected in the octave mixer 19 to mixing of signals within every octave, and signals of a total of 7 octaves are produced as signals respectively of every octave at output terminals 01 through 07. The sound-source series which is sound-source gated by one letter-name series (e.g., the C series) is only one letter-name series (the C series in this case) comprising frequency dividers which are successively connected in series. For this reason, the measure of establishing phase synchronism in the sound-source circuit is not necessary.

Further, this invention is not limited to these embodiments but various variations and modifications may be made without departing from the scope of the invention.

What is claimed is:

1. A keying system in an electronic musical instrument having a keyboard with keys which respectively correspond to letter names, the system comprising: means for generating harmonic level control voltages for controlling the levels of harmonics, inclusive of the first harmonic; means corresponding to the keys of the keyboard of the musical instrument being responsive to manipulation of said keys for generating envelope control voltages, the number of envelope control voltages corresponding to the number of keys; means for generating a medium voltage of a value between the maximum value of said envelope control voltages and the minimum value of said harmonic level control voltages; addition means comprising circuits each of which adds an envelope control current and a harmonic level control current to produce an output current, wherein the envelope control current is proportional to the voltage difference between each of said envelope control voltages and said medium voltage, and the harmonic level control current is proportional to the voltage difference between each of said harmonic level control voltages and said medium voltage; mixing means for respectively mixing output currents from the addition means corresponding to depressed keys having the same letter names with one another from the output currents of said addition means to produce gate control voltages which are respectively proportional to the sums of said output currents corresponding to depressed keys having the same letter names; a sound-source circuit for generating sound-source signals of frequencies of harmonics, inclusive of the fundamental tone, corresponding to the keys; and means for respectively gating the sound-source signals of the frequencies of the letter names corresponding to said gate control voltages among the signals from said sound source circuit, through the use of the gate control voltages of said mixing means.

2. A keying system in an electronic musical instrument as claimed in claim 1, which further comprises means for mixing the output signals of said gating means for each octave and obtaining signals of a plurality of octaves.

3. A keying system in an electronic musical instrument as claimed in claim 1, wherein: said addition means comprises a plurality of addition circuits provided in matrix state, each addition circuit comprising a combination of two resistors connected in series at a junction point and a diode being connected to said junction point, said envelope control voltages and said harmonic level control voltages being respectively applied to the non-joined ends of said series connected two resistors, and said mixing means comprising a plurality of transistors, each of said transistors having an emitter to which the output sides of those addition circuits respectively corresponding to the same letter names of said plurality of addition circuits are commonly connected, a base to which is applied said medium voltage, and a collector to which an output resistor is connected, said gate control voltages being obtained from the collectors of said transistors respectively.

4. A keying system in an electronic musical instrument as claimed in claim 1 in which said gating means comprises a transistor having a base to which the output of said mixing means is applied, an emitter to which the output sound-source signals of said sound-source circuit are applied, and a collector from which sound-source signals of envelope waveforms in accordance with the outputs of said mixing means are obtained.

5. A keying system in an electronic musical instrument as claimed in claim 1 in which said sound-source circuit comprises a plurality of groups of frequency-dividing circuits provided in correspondence to respective letter names of one octave, each group of frequency-dividing circuits comprising a plurality of frequency dividers in cascade connection supplied with a signal from the highest octave signal source of the respective letter name thereof and carrying of successive frequency division, and the outputs of the frequency dividers are supplied as sound-source signals to said gating means.

* * * * *